US005242234A

United States Patent [19]

Ahrens

[11] Patent Number: 5,242,234

[45] Date of Patent: Sep. 7, 1993

[54] DRAWING PEN

[76] Inventor: Hans-Joachim Ahrens, Kohlgartenstrasse 10, 0-3700 Wernigerode, Fed. Rep. of Germany

[21] Appl. No.: 5,593

[22] Filed: Jan. 19, 1993

[30] Foreign Application Priority Data

Jan. 17, 1992 [DE] Fed. Rep. of Germany ..... 4200964

[51] Int. Cl.[5] ..... B43K 8/00; B43K 8/16; B43K 8/18; B43K 5/06

[52] U.S. Cl. ..... 401/180; 401/134; 401/176; 401/177; 401/260

[58] Field of Search ..... 401/134, 176, 180, 260, 401/177

[56] References Cited

U.S. PATENT DOCUMENTS 2,188,662 1/1940 La France ..... 401/177 X 2,603,223 7/1952 Jefferson ..... 401/180 X

FOREIGN PATENT DOCUMENTS 878482 4/1953 Fed. Rep. of Germany ..... 401/180

60969 2/1955 France ..... 401/180

*Primary Examiner*—Steven A. Bratlie

*Attorney, Agent, or Firm*—John F. A. Earley; John F. A. Earley, III

[57] ABSTRACT

The present invention pertains to a drawing pen for applying viscous coating materials, with an essentially cylindrical grip part, a storage chamber arranged in the front section of the grip part for a cartridge containing the coating material, and a valve device arranged at the front end of the grip part, which is in flow connection with the interior space of the cartridge and has an application point for the coating material.

17 Claims, 4 Drawing Sheets

DRAWING PEN

Figure 1:
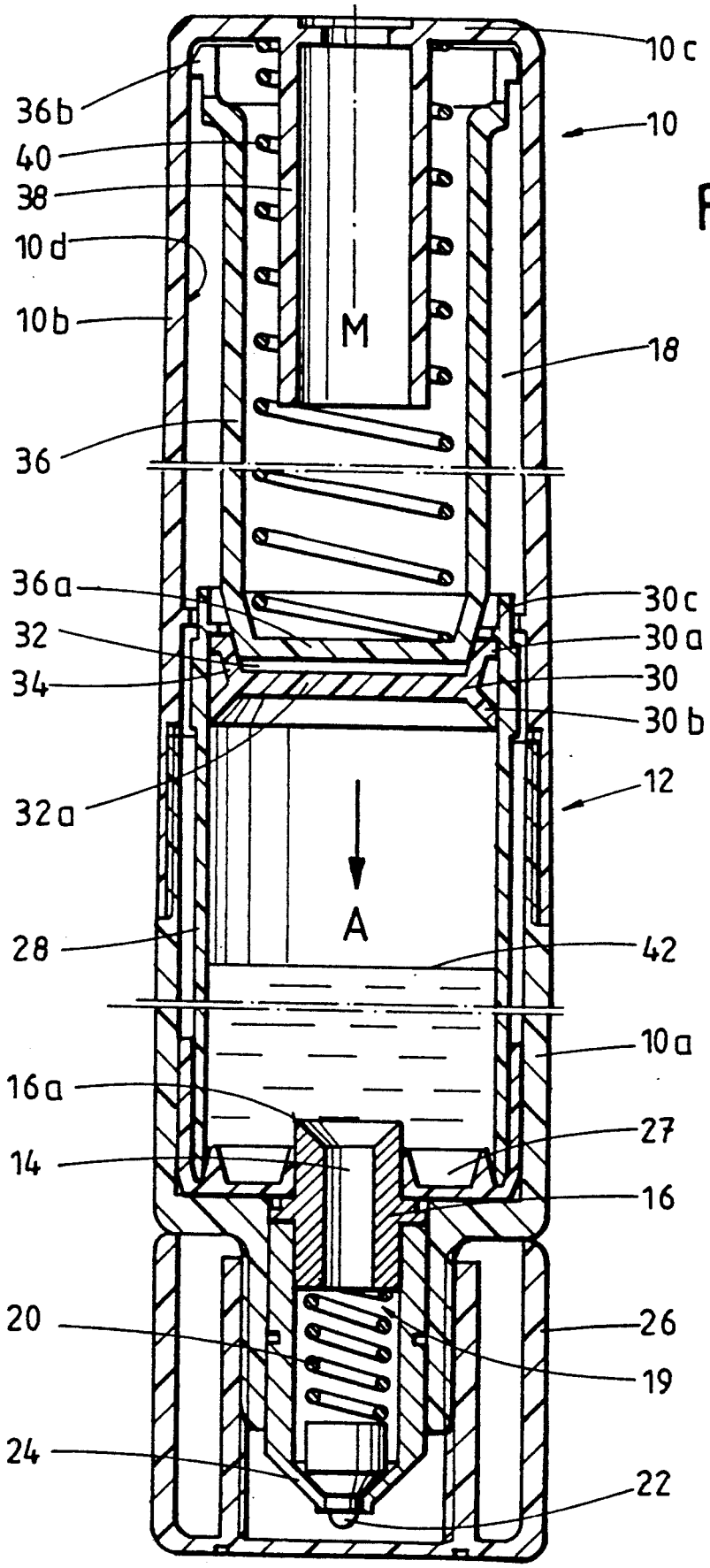

The present invention pertains to a drawing pen for applying viscous coating materials. The term "coating materials" is defined as paints, especially clear and pigmented varnishes, as well as marking inks, adhesives or the like, which are to be applied with a drawing pen.

The peculiarity of the said viscous coating materials is their viscosity, which even increases further with increasing duration of use of the corresponding drawing pen.

Drawing pens of this type generally exhibit the following characteristics:

an essentially cylindrical grip part, a storage chamber for a cartridge containing the coating material in the front section of the grip part, and a valve device arranged at the front end of the grip part, which is in flow connection with the interior space of the cartridge and has a application point for the coating material.

These drawing pens involve the risk that the coating material dries in and on the application point and obstructs the flow of paint.

Suggestions have therefore been made to pressurize the interior space of the cartridge. To do so, it has been suggested that the pressure in the interior space of the grip part be increased with a device of the type of an air pump. It is disadvantageous that the pressure decreases with increasing consumption of the coating material (and consequently with increasing dead space), so that the problems described will occur as before especially near the end of the use time of the cartridge.

A cartridge unit designed as a compressible tube does not lead to the desired result, either. This drawing pen is difficult to handle, and the pressure varies.

Therefore, the basic task of the present invention is to provide a drawing pen of the above-described class, which is easy to handle and provides a constant pressure onto its valve or application point, independently of the consumption of the cartridge. The reliability of the operation of the drawing pen, regardless of its working position, is also to be guaranteed by this.

This task is accomplished by the present invention based on the following considerations:

A pressurizing device, which acts on the cartridge or its contents, always has the disadvantage that the force of pressure applied decreases with increasing consumption of the coating material, i.e., with decreasing mass (volume) of the cartridge contents. This applies to both gas type pressurizing devices and mechanical pressurizing devices, e.g., springs. Thus, the spring force is highest in the tensioned state of the spring (i.e., when the cartridge is filled), and lowest when the cartridge is practically completely emptied (due to the spring now being expanded).

These different pressure forces are to be compensated mechanically. The present invention is based on the consideration of ensuring mechanical compensation by movable parts in the storage chamber of the grip part by guiding the movable part or parts in the direction of the application point as the consumption of the mass of the coating material in the cartridge increases and developing an increasingly lower static friction against the cartridge and/or the grip part.

In other words, when the cartridge is filled completely, the movable parts are to be arranged such that they will develop a high static friction against the cartridge and/or the grip part, thereby reducing the pressure force of the pressurizing device. In the state in which the cartridge is emptied practically completely, the static friction forces shall drop to zero, so that the now reduced pressure force of the pressurizing device will be able to fully exert its effect.

Adjustment of the pressure force exerted by the pressurizing device and the static friction opposing the pressure force is intended such that, regardless of the degree of filling of the cartridge, constant pressure forces will always act on the mass of the coating materials contained (remaining) in the cartridge.

As was explained above, the present invention offers two alternative, but closely related embodiments for this.

Based on a drawing pen with the above-described characteristics, a first embodiment is characterized as follows:

the inner cross-sectional area of the cartridge expands in the direction of the application point, at its rear end, the cartridge has a piston that is axially movable in the direction of the application point, the piston is in static frictional connection with the inner wall of the cartridge, pressure can be admitted to it from a pressurizing device arranged in the rear section of the grip part, and the pressurizing device presses the piston against the inner wall of the cartridge in the direction of the application point with increasing consumption of the coating material under a continuously decreasing static friction.

The terms "in front" and "in the rear" as well as "front" and "rear" end, always considered in the axial direction of the drawing pen, are to be understood such that "in front" means being in the area of the application point, while "in the rear" defines the rear free end of the grip.

In this embodiment the movable part consists of a piston which is guided along the conical inner wall of the cartridge, depending on the consumption of the cartridge. Since the cartridge has the smaller internal dimensions (the smaller internal diameter) at the rear end, the piston is under an especially high static friction here, while on its way toward the application point, it is moved into the area of the cartridge with larger internal cross section (larger internal diameter), as a result of which the static friction between the two parts correspondingly decreases, and may even drop to zero.

The material for the cartridge housing and the piston, as well as the conicity of the interior space of the cartridge are selected to be such that a constant pressure force will always be applied by the pressurizing device to the mass of the (residual) coating material.

It is advantageous in this sense for the piston to have a certain elasticity in order to thus optimally conform with the inner wall of the cartridge. It is thus ensured at the same time that the coating mass cannot flow out to the rear via the piston.

Consequently, a conventional drawing pen can be used in this embodiment. Only the cartridge needs to be designed in the manner according to the present invention in order to utilize the advantages described.

An alternative embodiment is characterized by the following characteristics:

the inner cross-sectional area of the rear section of the grip part becomes larger in the direction of the application point, the rear grip part contains a friction sleeve, which is provided, at the rear end, with a circumferential flange that is in static frictional connection with the inner wall of the grip part, and its front end is in contact with a piston, which is in static frictional contact with the inner wall of the cartridge, but is axially displaceable in the direction of the application point, pressure is admitted to the friction sleeve by a pressurizing device arranged in the rear part of the grip, and the pressurizing device presses the friction sleeve and thus indirectly the piston in the direction of the application point under continuously lowering static friction against the inner wall of the rear part of the grip, corresponding to increasing consumption of the coating material.

In this embodiment the cartridge may be either cylindrical, i.e., of the conventional design, or it may be designed according to the first embodiment variant.

The compensation of the pressure force applied by the pressurizing device is achieved here primarily with the said friction sleeve, whose cooperation with the inner wall of the rear part of the grip corresponds functionally essentially to the cooperation of the piston and the inner wall of the cartridge according to the first exemplary embodiment.

When the cartridge is full, the friction sleeve is in its "rear position," i.e., it lies essentially against the rear closing cap of the grip part and, on the outside, via the flange, against the section of the rear grip part, which has the smallest internal cross section. The static friction between the friction sleeve and the grip part is highest here. Consequently, a considerable portion of the pressure force exerted by the pressurizing device on the friction sleeve is lead into the wall of the grip part, so that it acts only partially o the cartridge or its piston. It is obvious that the pressurizing device must act directly on the friction sleeve in this embodiment. This [friction sleeve]can be designed with a front bottom part for this purpose, so that, e.g., a pressure spring is supported by this bottom with its front end and by the rear closing cap with its other end.

As the consumption of the cartridge increases, the spring presses the friction sleeve in the direction of the application point, which slides at the same time along the inner wall of the grip part, and, corresponding to the increasing cross-sectional area of the rear grip part, the static friction decreases. According to the present invention, the reduction of the static friction is proportional to the reduction of the spring force, so that a constant pressure force will be exerted on the piston of the cartridge as a result.

In this embodiment with a friction sleeve, the remaining volume of the storage chamber for the cartridge is limited at a given length of the grip part. To make it possible to use a larger cartridge with a larger storage capacity, an advantageous embodiment of the present invention suggests that the friction sleeve be designed as a multipart sleeve in the manner of a telescope. The friction sleeve shall now be divided into at least two sleeves that are telescopingly guided in one another, whose inner and/or outer circumferential surfaces are made conical in the axial direction in certain sections, so that the sleeves generate a continuously decreasing static friction against each other and/or against the inner wall of the rear part of the grip with increasing consumption of coating material in the cartridge.

The function of this exemplary embodiment corresponds, in principle, to the function of the above-described embodiment, so that reference is made thereto.

The drawing pen with divided friction sleeve can be specifically designed in different forms.

According to one example, the friction sleeve shall consist of an outer, cylindrical first sleeve, which is in contact, with a rear, outer flange edge, with the inner wall of the rear part of the grip, and accommodates an inner, second sleeve conically expanding in the direction of the application point, which is in contact with the piston with its front end.

As an alternative, the friction sleeve may also consist of an inner, first sleeve tapering conically in the direction of the application point, which is in contact, with its rear, outer flange edge, with the inner wall of the rear part of the grip, and it may be surrounded by an outer, cylindrical second sleeve, which is in contact, with a rear, inner flange edge, with the outer wall of the first sleeve, and is in contact with the piston with its end that projects over the first sleeve in the forward direction.

Based on the above-described principle of the multipart friction sleeve, it is possible to design further embodiments, and three-part friction sleeves or friction sleeves consisting of more than three parts may be provided as well. The above-mentioned embodiments may also be combined with one another.

It should always be ensured that the axial relative displacement of the individual sleeve parts be limited by corresponding stops in order for the friction sleeve (or its parts) to remain securely in the proper arrangement relative to one another even when the friction sleeve is "fully extended," i.e., the frontmost section of the friction sleeve is located at a short distance in front of the valve device when the cartridge is practically empty.

The friction sleeve and/or the piston are preferably elastic.

To facilitate handling, it is advantageous for the grip part to be made as a two-part grip part in the axial direction, wherein the rear section of the grip sleeve is to have a stop on the inside to fix the cartridge. After the replacement of an empty cartridge with a full one, the (individual segments) of the friction sleeve are thus again displaced in one another, until the stop will come to lie against the bottom of the cartridge in the completely mounted position and securely fixes it. It is particularly advantageous for the rear grip part to be screwed onto the front grip part.

To align the friction sleeve and to optimize applying of the static friction forces into the grip part (indirectly or directly), another embodiment is available, in which the piston is designed, at its end facing the friction sleeve, with a depression for accommodating the corresponding end of the friction sleeve. This depression shall preferably be designed conically in the direction of the application point, and at the distance from the base of the piston, the depression shall have a cross-sectional area that corresponds to the external diameter of the corresponding front end of the friction sleeve.

Thus, the friction sleeve does not act directly on the base of the piston, but is seated on the conical inner surface of the depression of the piston so that the pressure forces generated by the pressurizing device are deflected laterally.

As was mentioned above, the pressurizing device preferably consists of a pressure spring, which is arranged concentrically to the central longitudinal axis of the grip part and is supported at the grip part by the rear closing cap. Additional guiding elements may be provided here for the spring.

Even though the cartridge design described ensures that the viscous coating materials cannot flow out in the rearward direction, an additional safety can be achieved here by filling the coating material in a flexible bag arranged within the cartridge. As a result, the additional advantage is achieved that the entire cartridges does not need to be discarded after consumption of the coating material, but it is sufficient to replace the bag.

To provide a fluid connection between the contents of the bag (or the coating material) and the valve device and consequently the application point, a provision is finally made to design the valve device such that it extends into the front end of the grip part, e.g., with a feed tube, and has in this area a cutting device that pierces the front end of the cartridge when the cartridge is inserted, or cuts open a bag when it is inserted.

Further characteristics of the present invention will become apparent from the characteristics of the subclaims as well as the other application documents.

Figure 2:
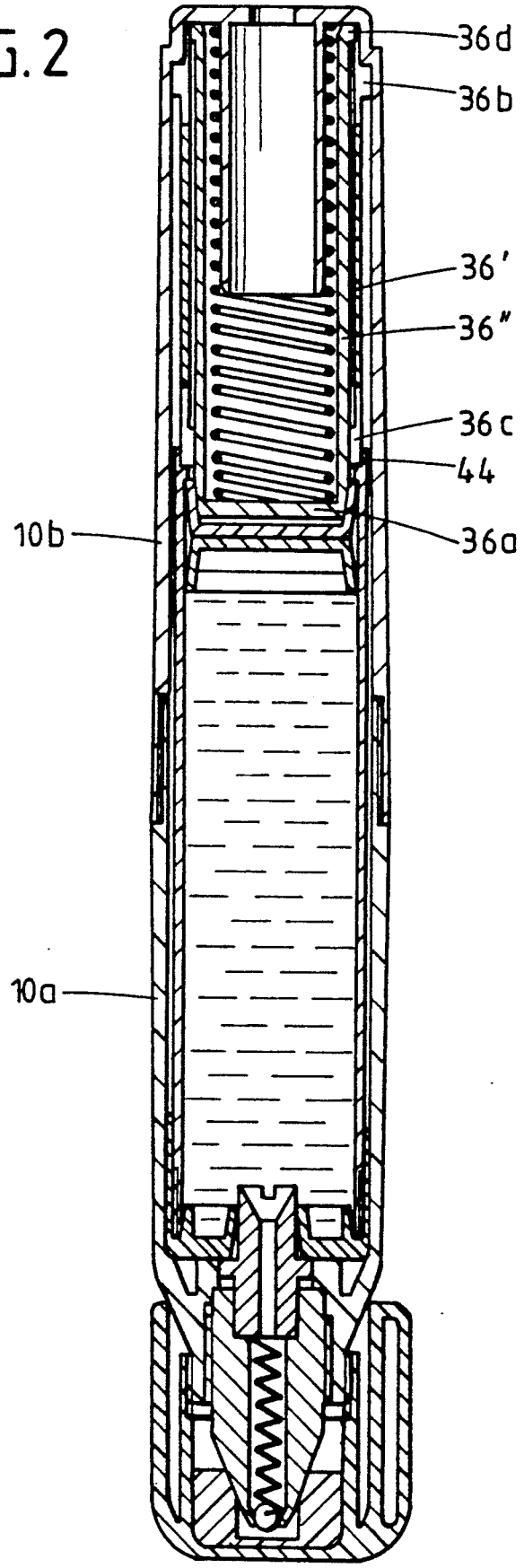
Figure 3:
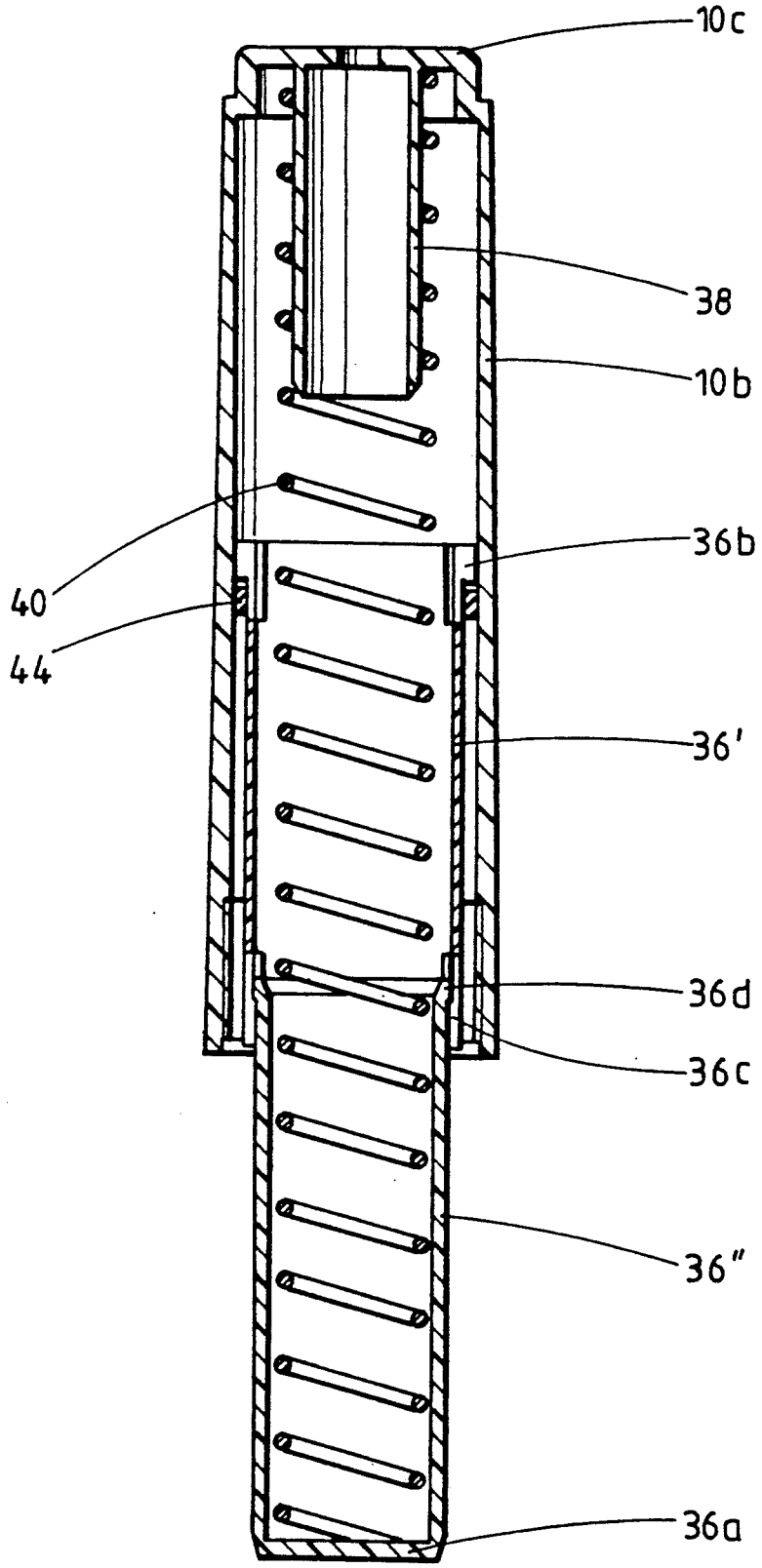
Figure 4:
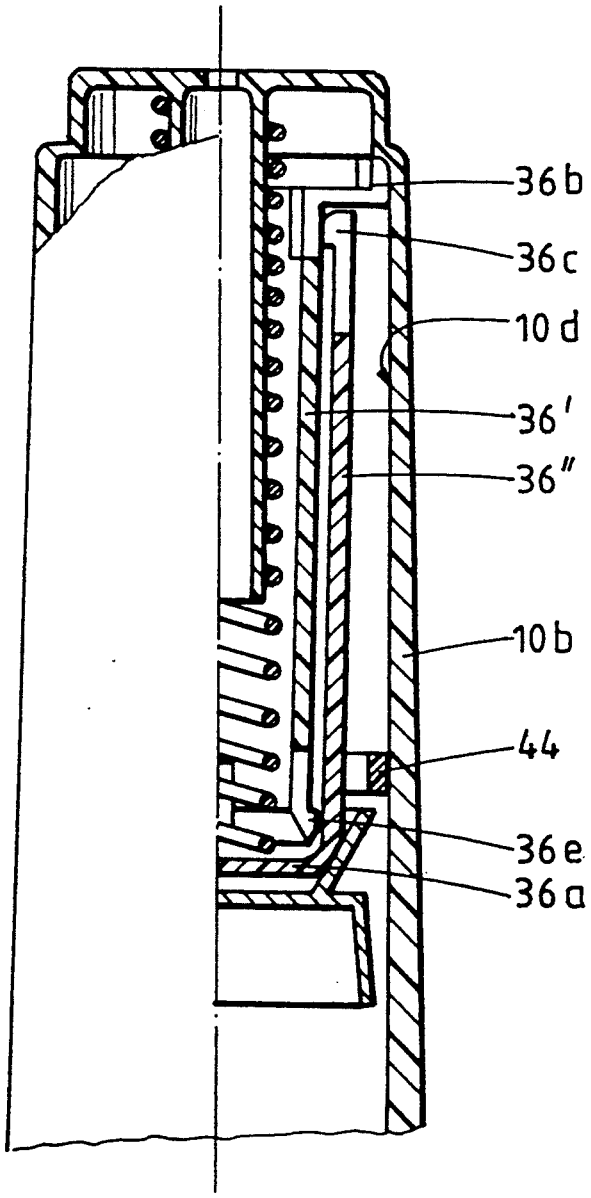

The present invention will be explained below on the basis of different exemplary embodiments. The description of the figures also contains generally applicable characteristics. Specifically, FIG. 1 shows a longitudinal section through a first embodiment of a drawing pen, FIG. 2 shows a longitudinal section through a second embodiment of a drawing pen with completely filled cartridge, FIG. 3 shows a longitudinal section through the rear section of the grip part of the drawing pen according to FIG. 2 in the state in which the cartridge is empty, and FIG. 4 shows part of the rear section of the grip part of a drawing pen in another embodiment in the state in which the cartridge is full.

Identical or functionally identical components are designated by the same reference numerals in the figures.

FIG. 1 shows a longitudinal section through a drawing pen according to the present invention.

Visible is a two-part grip part 10 consisting of a front section 10*a* and a rear section 10*b*, wherein the said rear part 10*b* is screwed onto the said front section 10*a* at 12. A metal tube 16 extends through an opening 14 provided in the front bottom section of the said grip part 10 into the storage chamber 18 of the said grip part 10. The said metal tube 16 is part of a valve device 19, to which a valve tip loaded by the force of a spring 20 with a spherical application point 22 arranged in a funnel-shaped mount 24 belongs. The said valve device is known as such and will not be described in greater detail here.

The front end of the drawing pen is covered by a cap 26.

The said metal tube 16 is provided, at its end projecting into the said storage chamber 18, with a pointed edge 16*a* designed in the manner of a cutting knife. The said edge 16*a* is used to pierce a front-end cap 27 of a cartridge 28 as soon as the said cartridge 28 is introduced into the front section 10*a* of the said grip part 10. The said cartridge 28 is filled with a coating material, here a pigmented varnish.

At the rear end, the said cartridge 28 is sealed by a piston 30, which is in contact with the inner wall of the said cartridge with outwardly projecting flanges 30*a, b*. An inner, annular projection 30*c* at the free rear end of the said cartridge 28 ensures that the piston 30 cannot slide out in the rearward direction.

The said cartridge 28 is designed as a cartridge that expands conically on the inside in the direction of the application point (arrow A), which will be discussed in greater detail below.

Both the said cartridge 28 and the said piston 30 consist of plastic, and especially the said piston 30 has a certain elasticity.

At its end that is associated with a rear bottom 10*c* of the said grip part 10, the said piston 30 has a depression 32, which is designed as a depression tapering conically in the direction of the said application point 22. As a result, a circumferential oblique surface 34 is formed, with which a bottom 36*a* of a friction sleeve 36 with a corresponding oblique surface is in contact at a distance from the base 32*a* of the said piston 30.

The said friction sleeve 36 is otherwise essentially cylindrical and has, at its rear end (top end in the figure), a circumferential, outer flange edge 36*b*, which is in contact with the corresponding inner wall of the said grip part 10.

As can be determined from the figure, the said rear section 10*b* of the said grip part 10 is designed as a rear section expanding internally conically in the direction of the said application point 22, so that the said rear grip part 10*b* has a smaller diameter in the area of the said flange 36*b* than in the area of the said bottom 36*a* of the said friction sleeve 36 (in the position shown in the figure).

A cylindrical projection 38, on which a pressure spring 40, which is supported at one end by the said bottom 10*c* and by the said bottom 36*a* of the said friction sleeve 36 at the other end, extends coaxially from the said bottom 10*c* to the central longitudinal axis M of the said grip part 10.

Thus, the said spring 40 directly presses the said piston 30, which, though being movable in the direction of arrow A, does not move in the state shown, because the said cartridge 28 is completely filled with the varnish mass.

If coating mass 42 is now consumed due to the use of the drawing pen, this causes the said friction sleeve 36 to be pressed in the direction of arrow A (i.e., in the direction of the said application point 22) under the pressure of the said spring 40. At the same time, the said piston 30 is also correspondingly guided in the direction of the application point due to the spring-actuated connection between the said friction sleeve 36 and the said piston 30.

The following is important in this connection:

Due to the conicity of the said section 10*b* of the said grip part 10 as well as the conicity of the said cartridge 28, both said flange 36*b* of the said friction sleeve 36 and the said flanges 30*a*, 30*b* of the said piston 30 are in contact with the corresponding inner surfaces of the said section 10*b* and the said cartridge 28, respectively, under maximum static friction. If the said friction sleeve 36 or the said piston 30 is now moved in the direction of arrow A, the parts reach sections of the said grip part 10*b* and of the said cartridge 28, respectively, which have larger diameters, i.e., the static friction between the corresponding components will decrease.

This is important also because the spring force of the said spring 40 decreases simultaneously with the expansion of the said pressure spring 40.

While a large portion of the spring force is deflected vectorially laterally at the beginning (in the position shown in FIG. 1) due to the described static frictions between the said components 36*b*, 10*b* and 30*a*, *b*, and 28, respectively, so that only part of the spring force acts on the said coating material 42, the decreasing spring force is now compensated for by a decreasing static friction, so that a constant axial force component will nevertheless become ultimately established for the said coating material 4 remaining in the said cartridge due to the path of displacement of the said friction sleeve 36 and the said piston 30, respectively.

In the embodiment shown in FIG. 2, the said friction sleeve 36 is designed as a two-part friction sleeve. It consists of an outer, cylindrical, first sleeve 36', which is in contact, with a said rear, outer flange edge 36*b*, with the said inner wall 10*d* of the said rear grip part 10*b*, and accommodates an inner, second sleeve 36", which expands conically in the direction of the said application point 22 and is in contact, with its front end (bottom 36*a*), with the said piston 30 and the oblique surface 34 thereof, respectively.

While FIG. 2 shows the state of the drawing pen with filled cartridge, FIG. 3 shows the said rear section 10*b* of the said grip part 10 in the state in which the said cartridge 28 is practically empty.

It follows from this that the said sleeves 36', 36" telescopingly slide out of each other in the forward direction in the direction of the arrow A with increasing consumption of the said coating material 42 under the action of the force of the said spring 40, and the relative movement of the said sleeves 36', 36" is limited by corresponding stops.

An annular projection 44, which is arranged on the said inner wall 10*d* of the said rear grip part 10*b* and also forms a stop for positioning the said cartridge 28, can be recognized in this connection.

As is apparent from FIG. 3, the said outer sleeve 36' is in contact with its said flange 36*b* with the said projection 44 in the fully extended position.

The path of movement of the said second sleeve 36" is limited by an outer flange 36*d* at the rear section of the said inner sleeve 36", which comes to lie, as can be determined from FIG. 3, against an internal flange 36*c* at the front end of the said outer sleeve 36'.

As was described, the said cartridge is practically empty in the state shown in FIG. 3. The said spring 40 has its greatest longitudinal extension, i.e., the spring force applied to the said piston 30 is lowest. The static friction between the said flange 36*b* and the said inner wall 10*d*, as well as the static friction between the said inner flange 36*c* and the said second sleeve 36", and, finally, the static friction between the said piston 30 and the said cartridge 28 are also the lowest, while the static friction has its maximum in the position shown in FIG. 2.

The function of the device as well a the compensation of the decreasing pressure forces of the said spring 40 by decreasing static frictions between the components described are analogous to the exemplary embodiment described above.

The mechanical attenuation of the spring deflection of the said sleeves 36', 36" as a result of the friction-versus-force curve described has another, safety-related effect as well. The telescope mechanism extends from the shaft (said grip part 10*b*) by slow rather than sudden spring deflection.

The exemplary embodiment according to FIG. 4 is distinguished by the different design of a said friction sleeve 36, which is likewise a two-part friction sleeve.

The said friction sleeve consists here of a said inner, first sleeve 36, tapering in the direction of the said application point 22, which is in contact, with a said rear, outer flange 36*b*, with the said inner wall 10*d* of the said rear grip part 10*b* and is surrounded by a said outer, cylindrical, second sleeve 36", which is in contact, with a said rear, inner flange 36*c*, with the outer wall of the said first sleeve 36' and is in contact, with its said end 36*a* projecting over the said first sleeve 36, in the forward direction, with the said piston 30.

As can be seen without any further explanation, the principle of operation of this embodiment corresponds to the principle of operation of the above-described exemplary embodiments.

The relative path of displacement of the said sleeves 36', 36" is limited by an additional outer projection 36*e* at the front end of the said first sleeve 36'.

I claim:

1. Drawing pen for applying viscous coating materials, possessing the following characteristics:
   - an essentially cylindrical grip part (10),
   - a storage chamber (18) arranged in the front section (10*a*) of the grip part (10) for a cartridge (28) containing the coating material (42),
   - a valve device (19) arranged at the front end (10*a*) of the grip part (10), which can be brought into flow connection with the interior space of the cartridge (28) and has an application point (22) for the coating material (42),
   - the inner cross-sectional area of the cartridge (28) increases in the direction of the application point (22),
   - the cartridge (28) has, at its rear end, a piston (30) that is movable axially in the direction of the application point (22),
   - the piston (30) is in static frictional contact with the inner wall of the cartridge (28),
   - pressure can be admitted from a pressure device (40) arranged in the rear section (10*b*) of the grip part (10), and
   - presses the piston (30) in the direction of the application point (22) with increasing consumption of the coating material under continuously decreasing static friction against the inner wall of the cartridge (28).

2. Drawing pen for applying viscous coating materials, possessing the following characteristics:
   - an essentially cylindrical grip part (10),
   - a storage chamber (18) arranged in the front section (10*a*) of the grip part (10) for a cartridge (28) containing the coating material (42),
   - a valve device (19) arranged at the front end of the grip part (10), which can be brought into flow connection with the interior space of the cartridge (28) and has an application point (22) for the coating material,
   - the inner cross-sectional area of the rear section (10*b*) of the grip part (10) increases in the direction of the application point (22),
   - the rear grip part (10*b*) contains a friction sleeve (36), which
   - is provided, at the rear end, with a circumferential flange (36*b*), which is in static frictional contact with the inner wall (10*d*) of the grip part (10) and
   - is in contact, with its front end (36*a*), with a piston (30), which is in contact with the inner wall of the cartridge (28) under static friction, but displaceably in the direction of the application point (22), pressure is admitted to the friction sleeve (36) from a pressurizing device (40) arranged in the rear grip part (10*b*), which presses the friction sleeve (36) and thus indirectly the piston (30) in the direction of the application point (22) with increasing consumption of the coating material (42) under continuously decreasing static friction against the inner wall (10*d*) of the rear grip part (10*b*).

3. Drawing pen in accordance with claim 2, in which the friction sleeve (36) is divided into at least two sleeves (36', 36") guided telescopingly in one another, whose inner and outer circumferential surfaces are designed conically in some sections in the axial direction such that the sleeves (36', 36") develop a continuously decreasing static friction among each other and/or against the inner wall (10*d*) of the rear grip part (10*b*) with increasing consumption of the coating material (42) in the cartridge (28).

4. Drawing pen in accordance with claim 3, in which the friction sleeve (36) consists of an outer, cylindrical first sleeve (36'), which is in contact, with a rear, outer flange (36*b*), with the inner wall (10*d*) of the rear grip part (10*b*), and accommodates an inner, second sleeve (36"), which conically expands in the direction of the application point (22) and is in contact, with its front end (36*a*), with the piston (30).

5. Drawing pen in accordance with claim 3, in which the friction sleeve (36) consists of an inner, first sleeve (36'), which tapers conically in the direction of the application point (22) and is in contact, with a rear, outer flange edge (36*b*), with the inner wall (10*d*) of the rear grip part (10*b*), and is surrounded by an outer, cylindrical, second sleeve (36"), which is in contact, with a rear, inner flange edge (36*c*), with the outer wall of the first sleeve (36') and is in contact, with its end (36*a*) projecting over the first sleeve (36') in the forward direction, with the piston (30).

6. Drawing pen in accordance with claim 1, in which the grip part (10) is designed as a two-part grip part in the axial direction, and the rear section (10*b*) has on the inside a stop (44) for fixing the cartridge (28).

7. Drawing pen in accordance claim 1, in which the piston (30) has a depression (32) for accommodating the corresponding end (36*a*) of the friction sleeve (36, 36") at its end facing the friction sleeve (36).

8. Drawing pen in accordance with claim 7, in which the depression (32) is designed as a depression tapering conically in the direction of the application point (22) and has, at a distance from the base (32*a*), a cross section corresponding to the outer dimensions of the corresponding front end (36*a*) of the friction sleeve (36, 36").

9. Drawing pen in accordance with claim 3, in which the different parts of the friction sleeve (36, 36', 36") are limited in their axial displacement relative to one another by inner and/or outer stops (36*c*, 36*d*, 36*e*).

10. Drawing pen in accordance with claim 1, in which the pressurizing device (40) consists of a pressure spring.

11. Drawing pen in accordance with claim 10, in which the pressure spring (40) is arranged concentrically to the central longitudinal axis M of the grip part (10) and is supported by a rear closing cap (bottom 10*c*) of the grip part (10).

12. Drawing pen in accordance with claim 1, in which the coating material (42) is filled into a flexible bag arranged within the cartridge (28).

13. Drawing pen in accordance with claim 1, in which the valve device (19) has a feed tube for the coating material extending into the front end of the grip part (10*a*) with a front-end cutting device (16*a*).

14. Drawing pen in accordance with claim 1, in which the cartridge (28), the piston (30), the friction sleeve (36, 36', 36"), and the grip part (10, 10*a*, 10*b*) consist of plastic.

15. Drawing pen for applying viscous coating materials, comprising:

an essentially cylindrical grip part (10), a storage chamber (18) arranged in the front section (10*a*) of the grip part (10) for a cartridge (28) containing the coating material (42), a cartridge (28) containing a coating material (42) positioned in the storage chamber (18), a valve device (19) arranged at the front end (10*a*) of the grip part (10), which can be brought into flow connection with the interior space of the cartridge (28) and has an application point (22) for the coating material (42), the inner cross-sectional area of the cartridge (28) increasing in the direction of the application point (22), the cartridge (28) having, at its rear end, a piston (30) that is movable axially in the direction of the application point (22), the piston (30) being in static frictional contact with the inner wall of the cartridge (28), a pressure device (40) arranged in the rear section (10*b*) of the grip part (10) for applying pressure to the piston (30), and the pressure device (40) pressing the piston (30) in the direction of the application point (22) with increasing consumption of the coating material under continuously decreasing static friction against the inner wall of the cartridge (28), the grip part (10) being designed as a two-part grip part in the axial direction, and the rear section (10*b*) having on the inside a stop (44) for fixing the cartridge (28), a friction sleeve positioned in the rear section (10*b*) of the grip part (10), the piston (30) having a depression (32) for accommodating the corresponding end (36*a*) of the friction sleeve (36, 36") at its end facing the friction sleeve (36), the depression (32) being designed as a depression tapering conically in the direction of the application point (22) and has, at a distance from the base (32*a*), a cross section corresponding to the outer dimensions of the corresponding front end (36*a*) of the friction sleeve (36, 36"), the pressurizing device (40) comprising a pressure spring, the pressure spring (40) being arranged concentrically to the central longitudinal axis M of the grip part (10) and being supported by a rear closing cap (bottom 10*c*) of the grip part (10), the coating material (42) being filled into a flexible bag arranged within the cartridge (28), the valve device (19) having a feed tube for the coating material extending into the front end of the grip part (10*a*) with a front-end cutting device (16*a*), and the cartridge (28), the piston (30), the friction sleeve (36, 36', 36"), and the grip part (10, 10*a*, 10*b*) being made of plastic.

16. Drawing pen for applying viscous coating materials, comprising:

an essentially cylindrical grip part (10), a storage chamber (18) arranged in the front section (10*a*) of the grip part (10) for a cartridge (28) containing the coating material (42), a cartridge (28) containing a coating material (42) positioned in the storage chamber (18), a valve device (19) arranged at the front end of the grip part (10), which can be brought into flow connection with the interior space of the cartridge (28) and has an application point (22) for the coating material, the inner cross-sectional area of the rear section (10*b*) of the grip part (10) increasing in the direction of the application point (22), the rear grip part (10*b*) containing a friction sleeve (36), which is provided, at the rear end, with a circumferential flange (36*b*), which is in static frictional contact with the inner wall (10*d*) of the grip part (10) and is in contact, with its front end (36*a*), with a piston (30), which is in contact with the inner wall of the cartridge (28) under static friction, but displaceably in the direction of the application point (22), a pressurizing device (40) arranged in the rear grip part (10*b*) for applying pressure to the friction sleeve (36), which presses the friction sleeve (36) and thus indirectly the piston (30) in the direction of the application point (22) with increasing consumption of the coating material (42) under continuously decreasing static friction against the inner wall (10*d*) of the rear grip part (10*b*), in which the friction sleeve (36) is divided into at least two sleeves (36', 36") guided telescopingly in one another, whose inner and outer circumferential surfaces are designed conically in some sections in the axial direction such that the sleeves (36', 36") develop a continuously decreasing static friction among each other and/or against the inner wall (10*d*) of the rear grip part (10*b*) with increasing consumption of the coating material (42) in the cartridge (28), in which the friction sleeve (36) consists of an outer, cylindrical first sleeve (36'), which is in contact, with a rear, outer flange (36*b*), with the inner wall (10*d*) of the rear grip part (10*b*), and accommodates an inner, second sleeve (36"), which conically expands in the direction of the application point (22) and is in contact, with its front end (36*a*), with the piston (30), in which the grip part (10) is designed as a two-part grip part in the axial direction, and the rear section (10*b*) has on the inside a stop (44) for fixing the cartridge (28), in which the piston (30) has a depression (32) for accommodating the corresponding end (36*a*) of the friction sleeve (36") at its end facing the friction sleeve (36), in which the depression (32) is designed as a depression tapering conically in the direction of the application point (22) and has, at a distance from the base (32*a*), a cross section corresponding to the outer dimensions of the corresponding front end (36*a*) of the friction sleeve (36"), in which the different parts of the friction sleeve (36, 36', 36") are limited in their axial displacement relative to one another by inner and/or outer stops (36*c*, 36*d*), in which the pressurizing device (40) consists of a pressure spring, in which the pressure spring (40) is arranged concentrically to the central longitudinal axis M of the grip part (10) and is supported by a rear closing cap (bottom 10*c*) of the grip part (10), in which the coating material (42) is filled into a flexible bag arranged within the cartridge (28), in which the valve device (19) has a feed tube for the coating material extending into the front end of the grip part (10*a*) with a front-end cutting device (16*a*), and in which the cartridge (28), the piston (30), the friction sleeve (36, 36', 36"), and the grip part (10, 10*a*, 10*b*) consist of plastic.

17. Drawing pen for applying viscous coating materials, comprising:

an essentially cylindrical grip part (10), a storage chamber (18) arranged in the front section (10*a*) of the grip part (10) for a cartridge (28) containing the coating material (42), a cartridge (28) containing a coating material (42) positioned in the storage chamber (18), a valve device (19) arranged at the front end of the rip part (10), which can be brought into flow connection with the interior space of the cartridge (28) and has an application point (22) for the coating material, the inner cross-sectional area of the rear section (10*b*) of the grip part (10) increasing in the direction of the application point (22), the rear grip part (10*b*) containing a friction sleeve (36), which is provided, at the rear end, with a circumferential flange (36*b*), which is in static frictional contact with the inner wall (10*d*) of the grip part (10) and is in contact, with its front end (36*a*), with a piston (30), which is in contact with the inner wall of the cartridge (28) under static friction, but displaceably in the direction of the application point (22), a pressurizing device (40) arranged in the rear grip part (10*b*), for applying pressure to the friction sleeve (36) which presses the friction sleeve (36) and thus indirectly the piston (30) in the direction of the application point (22) with increasing consumption of the coating material (42) under continuously decreasing static friction against the inner wall (10*d*) of the rear grip part (10*b*), in which the friction sleeve (36) is divided into at least two sleeves (36', 36") guided telescopingly in one another, whose inner and outer circumferential surfaces are designed conically in some sections in the axial direction such that the sleeves (36', 36") develop a continuously decreasing static friction among each other and/or against the inner wall (10*d*) of the rear grip part (10*b*) with increasing consumption of the coating material (42) in the cartridge (28), in which the friction sleeve (36) consists of an inner, first sleeve (36'), which tapers conically in the direction of the application point (22) and is in contact, with a rear, outer flange edge (36*b*), with the inner wall (10*d*) of the rear grip part (10*b*), and is surrounded by an outer, cylindrical, second sleeve (36"), which is in contact, with a rear, inner flange edge (36c), with the outer wall of the first sleeve (36') and is in contact, with its end (36a) projecting over the first sleeve (36'') in the forward direction, with the piston (30), in which the grip part (10) is designed as a two-part grip part in the axial direction, and the rear section (10b) has on the inside a stop (44) for fixing the cartridge (28), in which the piston (30) has a depression (32) for accommodating the corresponding end (36a) of the friction sleeve (36'') at its end facing the friction sleeve (36), in which the depression (32) is designed as a depression tapering conically in the direction of the application point (22) and has, at a distance from the base (32a), a cross section corresponding to the outer dimensions of the corresponding front end (36a) of the friction sleeve (36''), in which the different parts of the friction sleeve (36, 36', 36'') are limited in their axial displacement relative to one another by inner and/or outer stops (36c, 36e), in which the pressurizing device (40) consists of a pressure spring, in which the pressure spring (40) is arranged concentrically to the central longitudinal axis M of the grip part (10) and is supported by a rear closing cap (bottom 10c) of the grip part (10), in which the coating material (42) is filled into a flexible bag arranged within the cartridge (28), in which the valve device (19) has a feed tube for the coating material extending into the front end of the grip part (10a) with a front-end cutting device (16a), and in which the cartridge (28), the piston (30), the friction sleeve (36, 36', 36''), and the grip part (10, 10a, 10b) consist of plastic.

* * * * *